US005409350A

United States Patent [19]

Mitchell

[11] Patent Number: 5,409,350

[45] Date of Patent: Apr. 25, 1995

[54] WATER PUMP BEARING AND SEAL CARTRIDGE

[75] Inventor: Harold J. Mitchell, Pekin, Ill.

[73] Assignee: Caterpillar Inc., Peoria, Ill.

[21] Appl. No.: 145,280

[22] Filed: Oct. 29, 1993

[51] Int. Cl.[6] ..... F04D 29/12

[52] U.S. Cl. ..... 415/111; 415/113; 415/230; 415/231; 277/9; 277/39; 384/477; 384/483

[58] Field of Search ..... 415/111, 112, 113, 168.2, 415/170.1, 174.1, 174.2, 230, 231; 277/9, 38, 39, 42; 384/477, 483

[56] References Cited

U.S. PATENT DOCUMENTS

| | | | |
|---|---|---|---|
| 2,203,525 | 6/1940 | Dupree, Jr. | 415/111 |
| 2,769,390 | 11/1956 | Heimbuch | 415/111 |
| 3,540,833 | 11/1970 | Talamonti | 415/174.2 |
| 3,796,507 | 3/1974 | Smykal et al. | 415/111 |

FOREIGN PATENT DOCUMENTS

| | | | |
|---|---|---|---|
| 0405215 | 2/1934 | United Kingdom | 415/230 |
| 0719222 | 12/1954 | United Kingdom | 384/483 |
| 0836136 | 6/1960 | United Kingdom | 277/42 |

*Primary Examiner*—Edward K. Look
*Assistant Examiner*—Christopher Verdier
*Attorney, Agent, or Firm*—Dennis C. Skarvan

[57] ABSTRACT

A water pump for use mounted on an internal combustion engine includes a pump housing, a shaft rotatably disposed in the pump housing, a pumping element attached to the shaft, and a removable bearing and seal cartridge disposed in the pump housing. The removable bearing and seal cartridge includes a cartridge housing adapted for receipt mounted in the pump housing, bearing means for axially and radially locating the shaft relative to the pump housing, and sealing means for sealing working fluid from the bearing means.

11 Claims, 1 Drawing Sheet

WATER PUMP BEARING AND SEAL CARTRIDGE

TECHNICAL FIELD

The present invention relates generally to water pumps for use with an internal combustion engine and, more particularly, to a removable water pump bearing and seal cartridge for use in the assembly of and remanufacture of engine mounted water pumps.

BACKGROUND ART

Prior art engine mounted water pumps have typically included the individual assembly of the various water pump components. In particular, for a water pump including a pump housing, shaft, impeller, bearings and seals, the bearing races and sealing elements are individually assembled in the pump housing and on the shaft to build up the water pump assembly. While such a pump design and assembly method yields a conventional water pump having good overall performance characteristics, it does not necessarily result in an easily manufactured or serviceable pump design.

For example, conventional engine mounted water pumps are not easily field repaired due to the difficulty in re-establishing a precise bearing and seal assembly stack within the original manufacturing specifications. As a result, rather than repair the water pump in the particular field of service, the water pump is instead typically exchanged for a remanufactured water pump, thus incurring undue expense.

What is needed is an engine mounted water pump that is easily serviced, and if required, is easily repaired in the field. Such a water pump should allow a more precise and consistent assembly. Preferably, such a water pump should be compatable with light weight pump housings, such as those constructed of plastic or other reinforced composite laminate.

SUMMARY OF THE INVENTION

A coolant pump for use with the cooling system of an internal combustion engine is disclosed according to one embodiment of the present invention, comprising a pump housing defining a first bore adapted for receiving a pumping element and a second bore adapted for receiving a bearing and seal cartridge, a shaft rotatably disposed in the pump housing, the shaft extending between the first bore and the second bore, a pumping element attached to the shaft, the pumping element being disposed in the first bore, means for communicating working fluid between the pump housing and the pumping element, a removable bearing and seal cartridge disposed in the second bore, the removable bearing and seal cartridge including a cartridge housing adapted for receipt in the second bore mounted to the pump housing, bearing means, including outer race means adapted for receipt mounted in the cartridge housing and inner race means adapted for receipt mounted on the shaft, for axially and radially locating the shaft relative to the pump housing, and sealing means, including stator means adapted for receipt mounted in the cartridge housing and rotor means adapted for receipt mounted on the shaft, for sealing working fluid from the bearing means, and drive means for rotating the shaft and pumping element relative to the pump housing.

According to another embodiment of the present invention, an improved coolant pump for use with the cooling system of an internal combustion engine is disclosed, the coolant pump including a pump housing, a shaft and impeller assembly rotatably disposed in the pump housing, a pair of bearings adapted for axially and radially locating the shaft and impeller assembly relative to the pump housing, and a seal adapted for sealing coolant from the pair of bearings, wherein the improvement comprises the pair of bearings and the seal being mounted in a removable cartridge housing within the pump housing.

DETAILED DESCRIPTION OF THE PREFERRED EMBODIMENT

Figure 1:
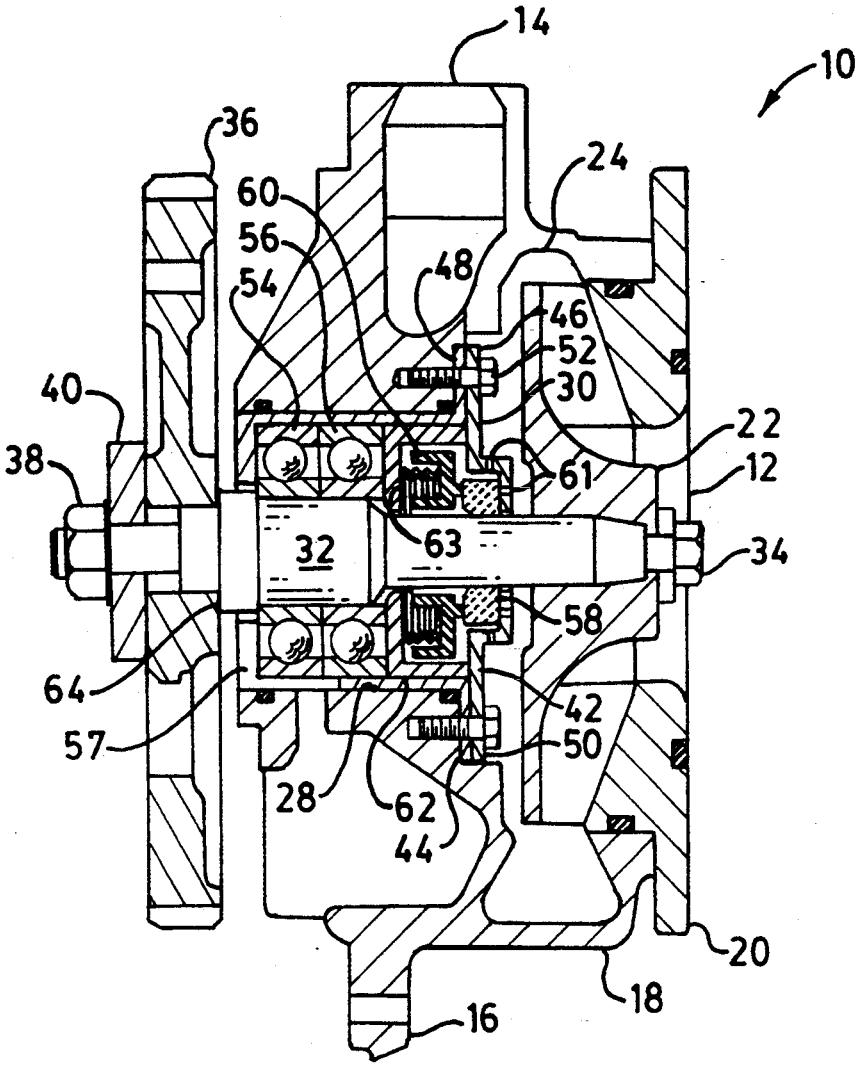
FIG. 1 is a cross-sectional view of a water pump for use with an internal combustion engine according to one embodiment of the present invention.

Referring now to FIG. 1, a water pump 10 is shown for use mounted to an internal combustion engine. Water pump 10 circulates working fluid, specifically engine coolant, within the coolant system of the internal combustion engine. As such, water pump 10 includes a pump inlet 12 in fluid communication with the low pressure side of the engine coolant system and a pump outlet 14 in fluid communication with the high pressure side of the engine coolant system.

Unlike prior conventional engine mounted water pumps which include individually assembled bearings and seals, water pump 10 of the present invention includes an easily serviceable bearing and seal cartridge which is readily substituted for a preassembled bearing and seal cartridge having factory preset bearing and seal clearances. As a result, rather than exchanging the entire water pump for a remanufactured water pump as typically required with prior art water pumps, only the bearing and seal cartridge in the water pump of the present invention is exchanged. The remaining pump housing and pumping element, which typically do not require repair, remain in the field and, perhaps, even still assembled mounted on the engine.

Water pump 10 includes a two-piece pump housing assembly 16 having a main housing 18 that houses generally the various pump components and an impeller housing 20 that defines a predetermined close running clearance with impeller 22. Main housing 18 is cast having internal passages in the form of an impeller bore 24 which houses impeller 22 and communicates pumped coolant received from impeller 22 to pump outlet 14 via internal passageways (not shown). Main housing 18 also includes a second bore 28 sized for receiving a bearing and seal cartridge 30.

Cartridge 30 includes generally bearing means and sealing means contained within a separate housing and is adapted for receipt mounted in second bore 28. Shaft 32 extends between bores 24 and 28 and is located axially and radially therein by cartridge 30. Impeller 22 is attached to shaft 32 by a locking fastener 34, or other such attachment means known in the art, and rotates with shaft 32 within bore 24. Drive means in the form of a gear 36 is mounted on the aft end of shaft 32 and clamped in place by fastener 38 and clamping member 40.

Referring now specifically to cartridge 30, a cartridge housing 42 includes first and second housing portions 44 and 46 semi-permanently attached together, such as by rivets, at flanged portions 48 and 50, respectively. The assembled flanged portions 48 and 50 are mounted by fasteners 52 to the main body portion 18 of pump housing 16. As such, cartridge 30 is both clamped in place within bore 28 and indexed relative to pump housing 16. Cartridge 30 includes as bearing means a pair of conventional matching spherical ball bearings, 54 and 56, pressed within housing portion 44. Lubricating oil is preferably supplied between bearings 54 and 56 and is drained via slot 57 provided in first cartridge housing portion 44.

Cartridge 30 further includes as sealing means a hydro-mechanical axial face seal assembly comprising rotor means in the form of a conventional seal rotor 58 and stator means in the form of a conventional seal stator 60 spring biased against a stator guide 62. Rotor 58 is mounted in place fixed relative to shaft 32 by a press fit and provides a hardened surface for running contact against stator 60. Stator 60 is mounted in place fixed relative to cartridge housing portion 44 and is constructed of a low friction material such as TEFLON, a polymerized tetrafluoro ethylene. Means in the form of cooling holes 61 are provided in cartridge housing portion 42 for circulating coolant against the rotating and stationary sealing elements to maintain the temperature rise in stator 60 and rotor 58 in the range of about one to two degrees Fahrenheit, and preferably below 1.5 degrees Fahrenheit. Bellows 63 is provided between stator 60 and guide 62 to seal therebetween and to provide spring biasing against stator 60.

Bearings 54 and 56 press onto shaft 32 during assembly of the shaft within cartridge 30. As a result, bearings 54 and 56 support shaft 32 both axially and radially within pump housing 16 with minimal play. Other bearing means as well are contemplated for use with the present invention. For example, matching pairs of split angular ball bearings or matching pairs of tapered roller bearings also could support shaft 32 both axially and radially within pump housing 16. Similarly, a conventional spherical ball bearing for supporting axial thrust loads adjacent or between a pair of conventional roller bearings for supporting radial loads could support shaft 32 both axially and radially within pump housing 16.

Seal rotor 58 also presses onto shaft 32 during assembly of the shaft within cartridge 30. As a result, a rotating seal interface is provided between stator 60 and rotor 58 to separate lubricating oil from pumped engine coolant. Other sealing means as well are contemplated for use with the present invention. For example, various types of lip seals riding on shaft 32 as well as circumferential face seals riding on shaft 32 could also provide sealing interfaces to separate lubricating oil from pumped engine coolant.

The assembly of cartridge 30 within main housing portion 18 is accomplished by pressing the assembly of shaft 32 and gear 36 within the cartridge, or alternatively by pressing the cartridge onto the shaft, until bearing 54 is seated onto shoulder 64 of shaft 32. The cartridge housing is then mounted in place on housing portion 18 via fasteners 52. Impeller 22 is then assembled and fastened onto shaft 32, and the impeller housing 20 is assembled over impeller 22 onto main housing portion 18. With the present invention, the bearing and seal cartridge can be replaced without removing water pump 10 from the engine by removing only the impeller housing 20 and impeller 22.

Still other objects and advantages of the present invention are apparent from the drawings and written description. For example, only a few common cartridge sizes may be provided to reduce part count and inventory, while still being usable with a variety of differing sized water pumps. Further, by strengthening the cartridge housing, the size and weight of the pump housing may be reduced and even be constructed from a low weight, high strength composite.

I claim:

1. A coolant pump for use with a cooling system of an internal combustion engine, comprising:

a pump housing defining a first bore and a second bore;

a shaft rotatively disposed in said pump housing, said shaft extending between said first bore and said second bore;

a pumping element attached to said shaft, said pumping element being disposed in said first bore;

a removable bearing and seal cartridge disposed in said second bore about said shaft, said bearing and seal cartridge being removable from said pump housing and said shaft for servicing thereof separate from said pump housing and said shaft;

said removable bearing and seal cartridge including a cartridge housing mounted to said pump housing, bearing means, including outer race means mounted within said cartridge housing and inner race means slidably received on said shaft, for axially and radially locating said shaft relative to said pump housing, and sealing means, including stator means mounted within said cartridge housing and rotor means slidably received on said shaft, for sealing working fluid from said bearing means; and drive means for rotating said shaft and pumping element relative to said pump housing.

2. The coolant pump for use with the cooling system of an internal combustion engine of claim 1, wherein lubricating fluid is supplied to said bearing means and working fluid is circulated between said pump housing and said impeller separate from said lubricating fluid.

3. The coolant pump for use with the cooling system of an internal combustion engine of claim 2, and further comprising means for cooling said sealing means.

4. The coolant pump for use with the cooling system of an internal combustion engine of claim 2, wherein said pumping element is an impeller.

5. The coolant pump for use with the cooling system of an internal combustion engine of claim 4, wherein said cartridge housing is constructed of a first housing portion semi-permanently attached to a second housing portion.

6. The coolant pump for use with the cooling system of an internal combustion engine of claim 5, wherein said drive means includes gear means, attached to said shaft, for rotating said shaft and said impeller relative to said pump housing.

7. The coolant pump for use with the cooling system of an internal combustion engine of claim 6, wherein said pump housing includes a first pump housing portion mounted to a second pump housing portion, said first pump housing portion and said second pump housing portion defining said first bore and receiving said impeller therebetween.

8. In a coolant pump for use with a cooling system of an internal combustion engine, the coolant pump including a pump housing, an impeller mounted to a shaft to define a shaft and impeller assembly rotatively disposed in said pump housing, a pair of bearings slidably received on said shaft for axially and radially locating said shaft and impeller assembly relative to said pump housing, and a seal slidably received on said shaft for sealing coolant from said pair of bearings, the improvement comprising said pair of bearings and said seal being mounted in a cartridge housing within said pump housing to define a bearing and seal cartridge, said bearing and seal cartridge being removable from said pump housing and said shaft for servicing thereof separate from said pump housing and said shaft.

9. The improvement of claim 8, wherein each of said pair of bearings includes an outer race mounted in said cartridge housing and an inner race mounted on said shaft and said seal includes a seal stator mounted in said cartridge housing and a seal rotor mounted on said shaft.

10. The improvement of claim 9, and further comprising means for communicating said coolant to said seal stator and said seal rotor.

11. The improvement of claim 10, wherein said cartridge housing is constructed of a first housing portion semi-permanently attached to a second housing portion.

* * * * *